US006348651B1

(12) United States Patent
Chou et al.

(10) Patent No.: US 6,348,651 B1
(45) Date of Patent: Feb. 19, 2002

(54) TWIST PATTERN TO IMPROVE ELECTRICAL PERFORMANCES OF TWISTED-PAIR CABLE

(75) Inventors: Chih-Hsien Chou, San Jose; David Quiroz, Convina; Joseph Tang, Montery Park, all of CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/535,426

(22) Filed: Mar. 27, 2000

(51) Int. Cl.[7] ..... H01B 11/04
(52) U.S. Cl. ..... 174/27; 174/117 F
(58) Field of Search ..... 174/117 F, 27, 174/34; 57/204, 293

(56) References Cited

U.S. PATENT DOCUMENTS 2,038,240 A * 4/1936 Schelkunoff ..... 174/34 X
3,757,028 A * 9/1973 Schlessel ..... 174/34 X
4,381,426 A * 4/1983 Cronkite et al. ..... 174/117 F

* cited by examiner

*Primary Examiner*—Chau N. Nguyen
(74) *Attorney, Agent, or Firm*—Wei Te Chung

(57) ABSTRACT

A twisted-pair cable includes a plurality of twisted pairs of conductors closely side by side arranged one another. The pair of conductors are twisted with some degrees axially offset relative to the adjacent twisted pair of conductors, whereby for each victim conductor, the induced signals can be eliminated within each twisted cycle, so that the crosstalk at the far end of the cable can be reduced.

7 Claims, 7 Drawing Sheets

TWIST PATTERN TO IMPROVE ELECTRICAL PERFORMANCES OF TWISTED-PAIR CABLE

BACKGROUND OT THE INVENTION

1. Field of the Invention

The invention relates to twisted-pair planar cables, and particularly to the twisted-pair cable having 90 degrees phase/node offset between every adjacent two pairs cables.

2. The Related Art

The twisted pair electrical cable has long been known to posses much better electrical characteristics than the purely parallel lay wires or cable, e.g., flat cable, wherein each pair of insulated conductors are typically twisted together along the length of the cable. The geometry of the twisted pairs is known to produce the desirable electrical characteristics of low crosstalk and high immunity from interference from external magnetic fields. FIG. 1 which is the main drawing of U.S. Pat. No. 4,486,619, shows the first generation conventional twisted pair electrical cable.

FIG. 2 shows the second generation conventional electrical cable wherein every adjacent two pairs of conductors are twisted in a reverse manner with each other. For example, in FIG. 2 the first upper pair 1 are twisted along its length clockwise from a right side viewpoint position, and the second upper pair 2 are twisted along its length counter-clockwise from the same right side viewpoint position. And the third upper pair 3 are again twisted along its length clockwise from the same right side viewpoint position.

This alteration is to try to further counterpoise the Electro-magnetic effects thereamoung, so as to expect to reduce the induce the signals(noises) of one pair of conductors due to its adjacent pairs of conductors. In other words, the twisted pair cable is adopted to reduce crosstalk noise in the differential signal applications because the wires in the pair are close to each other to expect to have the common-mode induced signals from the noise source and such common-mode induced signals will be counterpoised in the differential applications. Additionally, the overall Electro-magnetic filed is expected to be reduced due to the opposite polarity between the neighboring loops in the pair.

Anyhow, the results are not as good as expected. The reason is that this concept may be workable when the subject pair of conductors are far distant from the adjacent pair of conductors. Under that situation, the distance between the adjacent pairs of conductors is much larger than the distance between the two internal conductors within each pair of conductors, and thus the influence applied to the pair of conductors can be regarded as from a single source of the adjacent pair of conductors.

In fact, oppositely the pairs of conductors are closed side by side arranged with each other. The distance between the adjacent pairs of conductors are generally close to the distance between the two internal conductors within each pair of conductors. Under this situation, the influence of the subject pair of conductors should be measured by the individual conductors of the adjacent pair of conductors. In other words, when the ratio of the distance between the twisted pairs to the distance between the internal conductors (wires) in the each twisted pair becomes smaller, the difference of the induced noises of the two internal conductors of the twisted pair will become larger, and can not be treaded as common-mode induced signals. Thus, a net crosstalk noise occurs. The reasons are as below.

As shown in FIGS. 3(A) and 3(B), for the uniform twisted pair cable of FIG. 2, the far end crosstalk may be unstably either accumulated or cancelled in the individual period depending upon the data pattern of the current in the neighbor pairs. As understood, the induced noises of the conductor of each pair are mostly effected only by the two closest neighbor pairs by two sides of the subject pair, and thus the discussion is among these three pairs. Anyhow, it should be understood that each conductor of the subject pair can be a victim one which is influenced by the conductor of the adjacent pair while simultaneously it can also be a driving one influencing the other conductor of the adjacent one.

In FIG. 3(A), the upper or driving pair 50 include the conductor 52 assuming with −1 V thereof and the conductor 54 assuming with +1 V thereof, and the lower or driving pair 60 include the conductor 62 assuming with −1 V thereof and the conductor 64 assuming with +1 V, to be commonly positioned by two sides of the middle or victim pair 70 include the conductors 72 and 74. For the conductor 72, the current of the victim conductor 72 will carries an induced signal(noise) occurring around the point 72A due to inducement to the driving conductor 54 and sequentially carries another induced signal occurring around the point 72B due to inducement to the driving conductor 64. Understandably, the similar induced signals will occur around every closer positions between the victim conductor 72 and the corresponding driving conductors 54, 64, and be accumulated along the whole length of the victim conductor 72. Undoubtedly, the far end P of the cable will have a high crosstalk thereof. The other conductor 74 follows the same format.

Differently, if the data pattern of the current is arranged as in FIG. 3(B) wherein the conductor 52 assuming with +1 V instead of −1 V in FIG. 3(A), and the conductor 54 assuming with −1 V instead of +1 V FIG. 3(A), the results will be totally different. Under this situation, for the conductor 72, the current of the victim conductor 72 will carry the induced signal around the point 72A which is generated by the driving conductor 54, and further carry the induced signal around the point 72B which is generated by the driving conductor 64, while the former induced signal and the latter induced signal will be mutually eliminated with each other because of the opposite polarities of the driving conductors 54 and 64. Understandably, the far end P of the conductor 72 of the cable has a lower crosstalk. The other conductor 74 follows the same format.

Understandably and unfortunately, the data pattern of the current in each conductor is of an indirect current and thus not controllable. +1 V and −1 V are interchanged with each other several times in the conductor within each second whereby the data pattern in each conductor is randomly different at each specific moment. It is impossible to arrange the whole system as in a format shown in FIG. 3 consistently and permanently. Therefore, the crosstalk around the far end of the cable is uncontrollably too high to be acceptable.

Recently, some attempts have been taken to reduce these induced signals from different approaches, wherein irregularities arrangement has applied to the conductors either within each pair of conductors or among the adjacent pairs of conductors for lowering crosstalk, insertion loss or return loss, for example, U.S. Pat. Nos. 3,736,366 and 5,767,441. Anyhow, the random, changeable, or irregular arrangement of the pairs of conductors is not a scientific way to either design or manufacture the corresponding components where the designer has no strong confidence in quality consistence or precisely manufacturing. Therefore, it is desired to have a scientific, systematic, reliable and predicable arrangement in the twisted pair cable for efficiently reducing the induced noises thereof.

SUMMARY OF THE INVENTION

According to an aspect of the invention, an electrical cable includes a plurality of twisted pairs of conductors thereof. The pair of conductors are twisted with some degrees axially offset relative to the adjacent twisted pair of conductors, whereby for each victim conductor of each pair of conductors which is measured for each twisting cycle by 0 through 360 degrees, the first section within the 0–90 degrees range is influenced by one first conductor of one adjacent first pair of driving conductors while simultaneously the second section within the 90–180 degrees range is influenced by the other second conductor of the same one adjacent first pair of driving conductors under the condition that the first conductor and the second conductor are of opposite polarities, thus the combined induced signals (noises) of the victim conductor is close to zero. Similarly, for the same victim conductor of the same pair of conductors, the third section within the 180–270 degrees range is influenced by one third conductor of the other adjacent second pair of driving conductors while simultaneously the fourth section within the 270–360 degrees range is influenced by the other fourth conductor of the same other adjacent second pair of driving conductors under the condition that the third conductor and the fourth conductor are of opposite polarities, thus the combined induced signals (noises) of the victim is close to zero. Accordingly, for each victim conductor within each twisting cycle of 0–360 degrees range, the compound induced signal is itself eliminated as low as zero. Thus, the far end of the cable through several twisting, still owns the very low value of the induced signal.

DETAILED DESCRIPTION OF THE PREFERRED EMBODIMENTS

Figure 1:
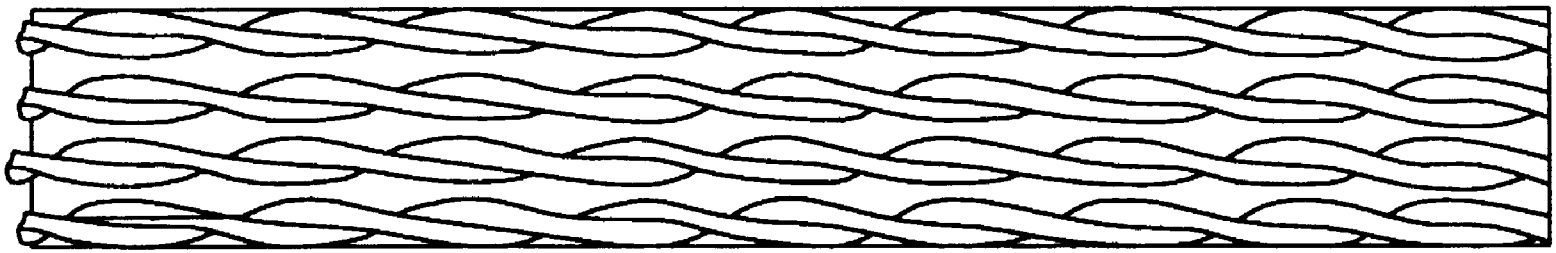
FIG. 1 (PRIOR ART)
FIG. 1 is a plan view of the twisted pair cable of the prior art with all pairs of conductors are twisted along the axis in the same direction.
Figure 2:
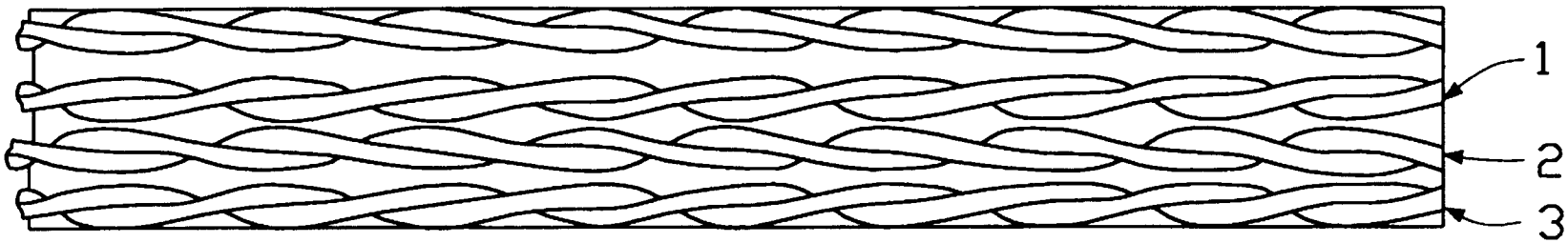
FIG. 2 (PRIOR ART)
FIG. 2 is a plan view of the twisted pair cable of the prior art with the adjacent pairs of conductors are twisted along the axis in the opposite directions.

References will now be made in detail to the preferred embodiments of the invention. While the present invention has been described with reference to specific embodiments, the description is illustrative of the invention and is not to be construed as limiting the invention. Various modifications to the present invention can be made to the preferred embodiments by those skilled in the art without departing from the true spirit of the invention as defined by the appended claims.

It will be noted here that for a better understanding, like components are designated by like reference numerals throughout the various figures in the embodiment. Attention is directed to FIG. 4 wherein a twisted pair cable 10 includes plural pairs of conductors wherein each pair of conductors are of opposite polarities thereof. It can be seen that every adjacent two pairs of conductors are twisted along the axial direction in opposite directions, i.e., one in a clockwise direction while the other in a counterclockwise direction. It is also understood that even though in FIG. 4 which is expressed via the same way as FIGS. 3(A) and 3(B), it seems that the two twisted conductors of each twisted pair of conductors are disclosed with the peak section (i.e., upper portion), the valley section (i.e., lower portion) and the intersection section (node section) along the axial direction of the pair of conductors, it should be noted the true dimensions of the conductors remain the same from a three dimensional viewpoint because this pair of conductors are twisted axially in space. The two dimensional plan view is for easy illustration.

Therefore, for the first victim conductor 22 of the victim pair 26 of conductors, for each cycle wherein the first victim conductor 22 is mutually twisted around the second victim conductor 24 from 0 degree and back to 360 degrees (i.e., 0 degree), the section 25 within the 0–90 degrees range (i.e., P1–P2) is influenced by one driving conductor 32 of the adjacent driving pair 36 of the conductors while the section 26 within the 90–180 degrees range (i.e., P2–P3) is influenced by the other driving conductor 34 of the same adjacent driving pair 36 of conductors under the condition that the driving conductor 32 and the driving conductor 34 are of the opposite polarities. Thus the induced signals imposed on sections 25 and 26 are generally mutually canceled, and the compound induced signal (i.e., crosstalk) is close to zero.

Similarly, for the same victim conductor 22, the section 27 within the 180–270 degrees range (i.e., P3–P4) is influended by one driving conductor 42 of the other adjacent driving pair 46 of conductors while the section 28 within the 270–360 degrees range (P4–P5) is influenced by the other driving conductor 44 of the same driving pair 46 of conductors under the condition that the driving conductor 42 and the driving conductor 44 are of the opposite polarities. Thus, the compound induced signal is close to zero. Because the combined induced signal of the sections 25 and 26 (i.e., P1–P3) is close to zero, and the combined induced signal of the sections 27 and 28 (i.e., P3–P5) is also close to zero, the compound induced signal of the one cycle including sections 25, 26, 27 and 28, (i.e., P1–P5), is ideally proximate zero for each moment. Because the victim conductor 22 is composed of the continuous cycles and each cycle has a very low induced signal value, the crosstalk at the far end P of the conductor 22 which is an accumulated value of such serial cycles, also reaches a very low value.

The same format and results are also applied to the other victim conductors 24. Therefore, the whole crosstalk value at the far end of the twisted victim pair 26 of conductors is very low. Accordingly, the crosstalk at the far end of the cable 10 which is calculated by sum of all the pairs of conductors, is also reaches a very low value.

Figure 3A:
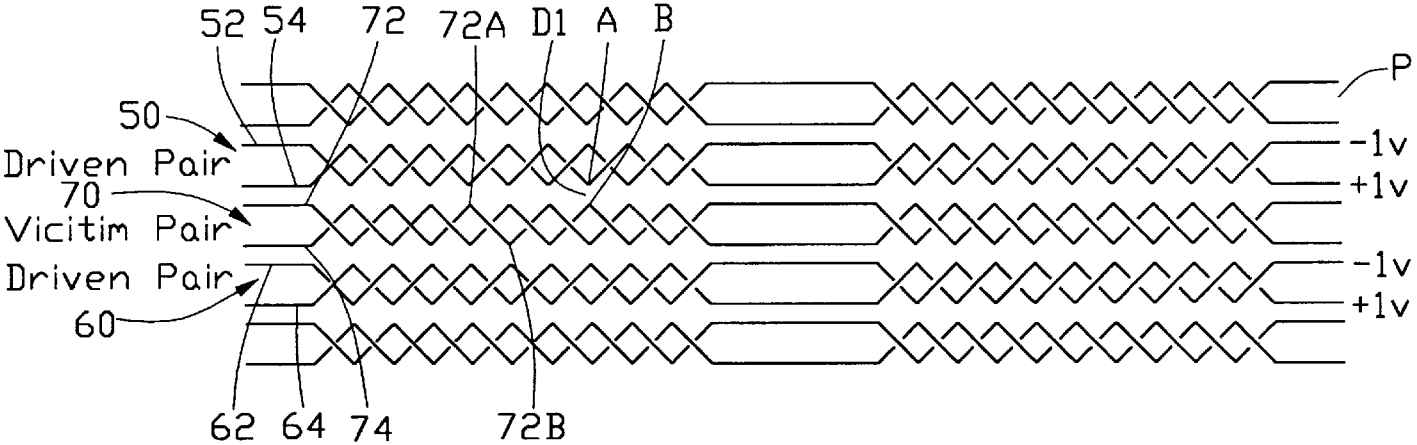
FIG. 3A (PRIOR ART)
FIG. 3(A) is a simplified plan view of the twisted pair cable of FIG. 2 for easy illustration wherein the upper adjacent pair of driving conductors and the lower adjacent pair of driving conductors are of the same data pattern, thus resulting in high crosstalk at the far end of the cable.
Figure 3B:
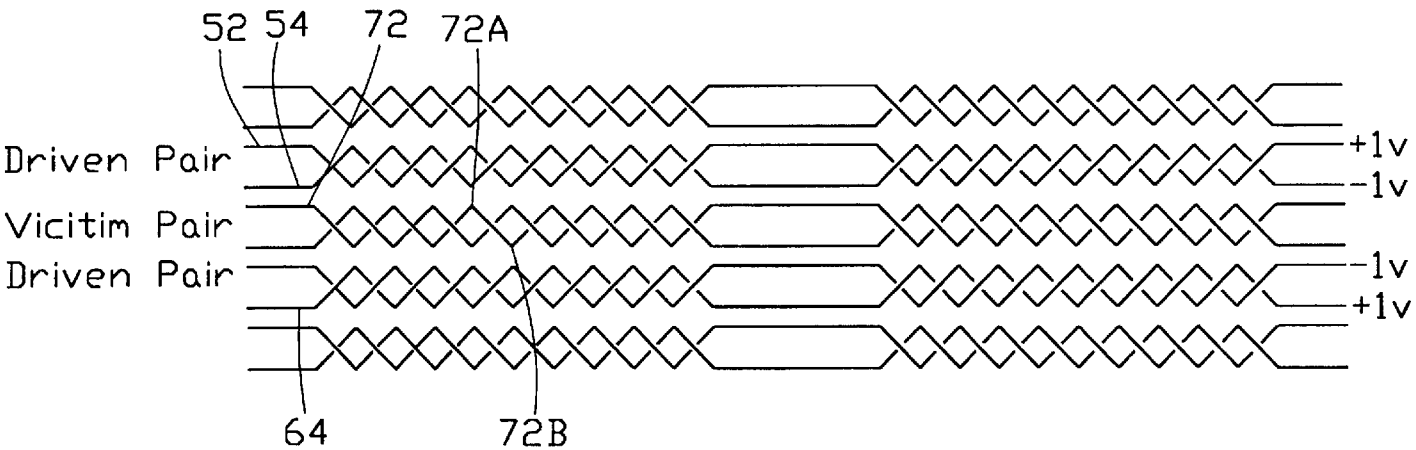
FIG. 3B (PRIOR ART)
FIG. 3(B) is a simplified plan view of the twisted pair cable of FIG. 2 for easy illustration wherein the upper adjacent pair of driving conductors and the lower adjacent pair of driving conductors are of the opposite data pattern, thus resulting in low crosstalk at the far end of the cable.
Figure 4:
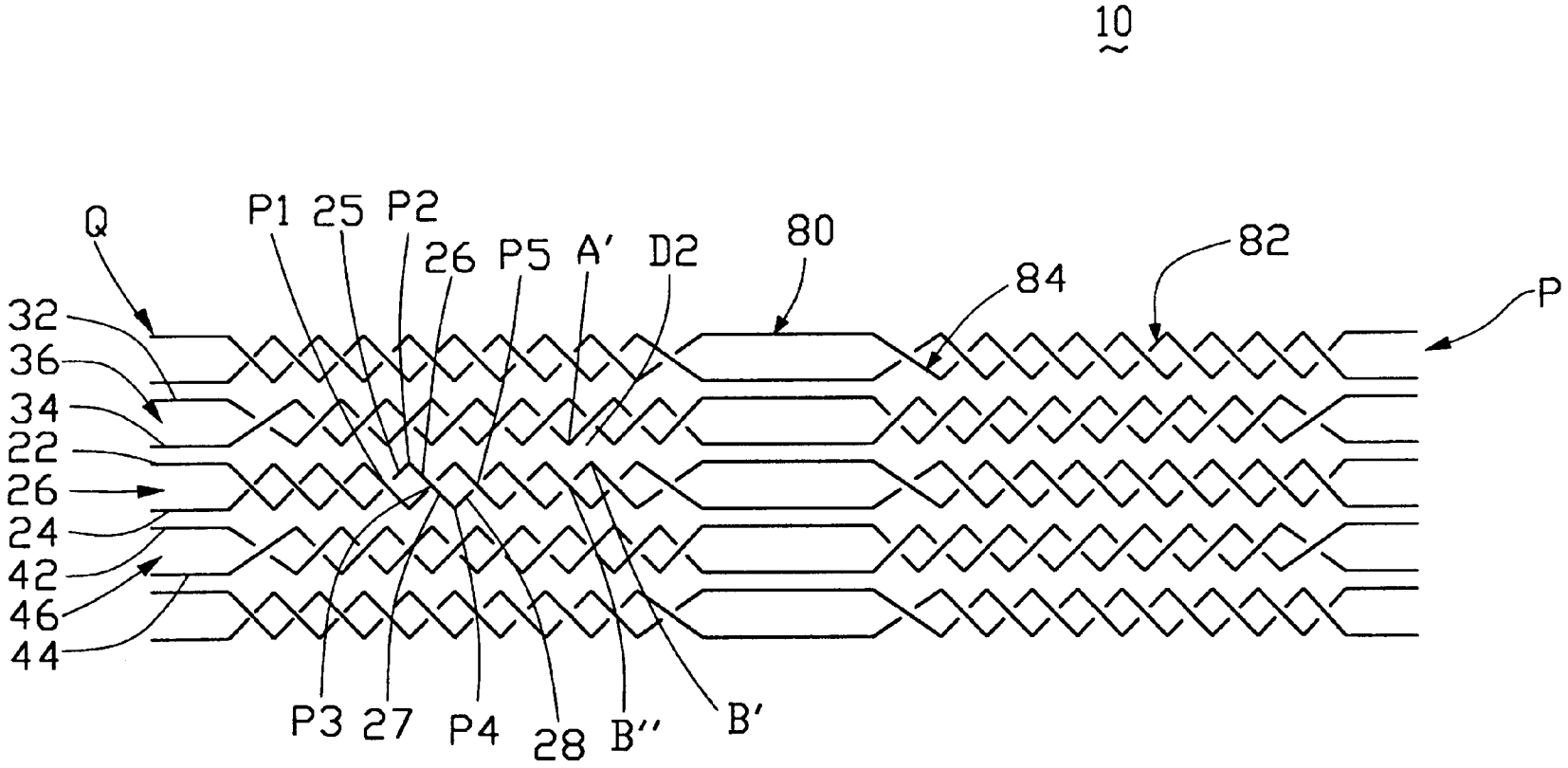
FIG. 4 is a simplified plan view of the twisted pair cable of a presently preferred embodiment of the invention for easy illustration wherein the twist phases of the adjacent two pairs of conductors are offset with generally 90 degrees.

It should be noted that different from the prior arts disclosed in FIGS. 3(A) and 3(B) where the induced signal on the section due to one driving pair is unreliably expected to be possibly eliminated or compensated by another one generated by another driving pair, in the invention the induced signal on the section 25(27) due to one driving pair 36(46), can be surely eliminated by another one on the section 26(28) generated by the differential coupling of the same driving pair 36(46). The crosstalk at the far end P of the cable is reliably and systematically lowered to a minimum value.

It is also noted that because of the twist phase offset (difference), the distance D1 between the two closest points A and B (FIGS. 3(A) and 3(B)) of the two adjacent pairs of conductors of the prior art twisted-pair cable, which are taken from a same lateral position and are located on the same plane can be increased as shown in FIG. 4 with label D2 between the two closest points A' and B' which are located on the same plane while can not be in the same lateral position. The increased distance also significantly reduces the value of the induced signal due to the reverse proportion relationship therebetween. Similarly, another closest point B" which may taken in the same lateral position while is not located in the same plane with point A, is also relatively far away from point A in comparison with the relationship between points A and B.

It should be noted that even though in this embodiment 90 degrees twist phase offset is arranged, all the odd number pairs are arranged with the same format with each other including the twist phase and the twist direction, and all the even number pairs are arranged with the same format with each other including the twist phase and the twist direction, the other variations may be used. For example, the twist phase offset may be within a range instead of the specific value, i.e., 90 degrees. The odd number pairs may not require all the same format so as to comply with or adjust to the manufacuring machine.

Figure 5:
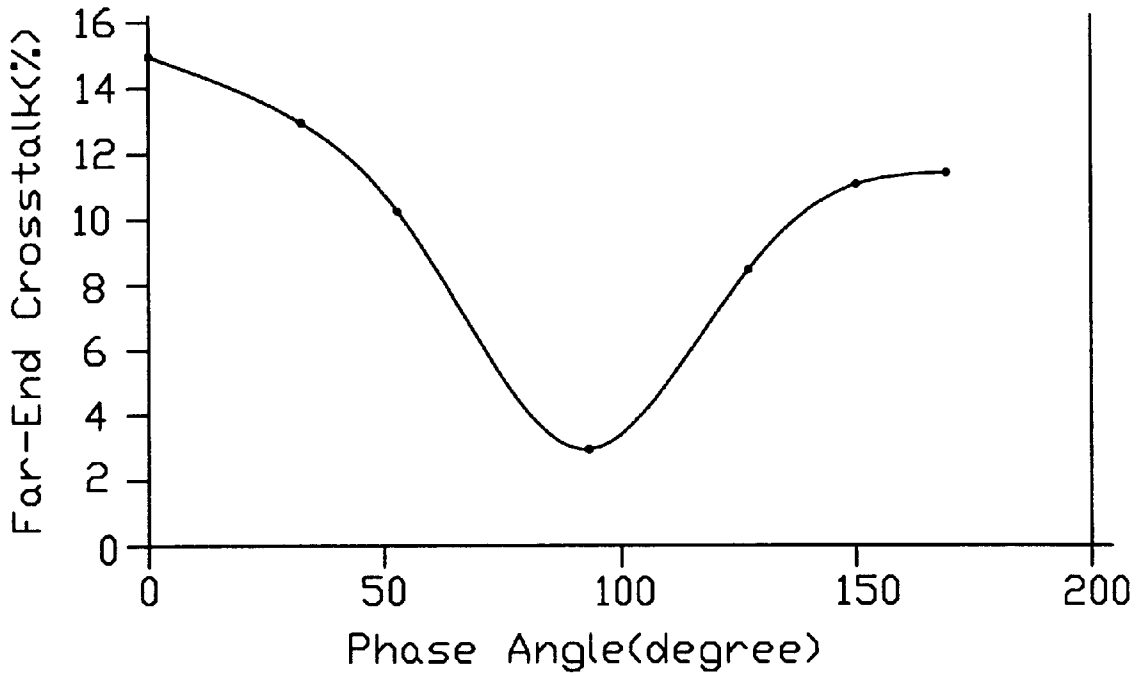
FIG. 5 is a diagram showing the relation between the resulting compound induced signal at the far end of the cable, and the range of the offset angle.

Therefore, FIG. 5 shows the relationship between the twist phase offset range and the crosstalk at the far end of the cable, wherein 90 degrees offset phase angle reaches the best results.

Figure 6:
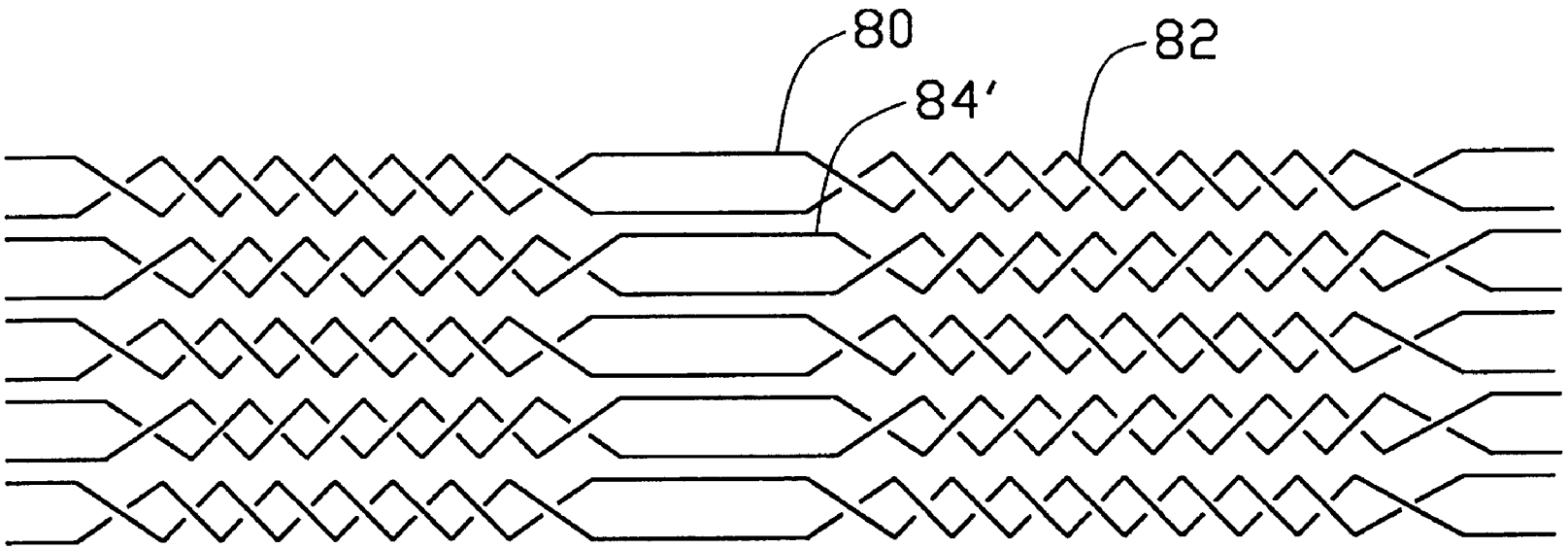
FIG. 6 is a simplified plan view of another twisted pair cable of the invention having differently configured transition area for manufacturing consideration.

It is noted that the twisted pair cable are composed of the alternative flat sections 80 (for termination with the corresponding connectors thereon) and the twisted sections 82 therealong. To prevent the skew phenomenon due to the offset arrangement in the invention, other than the one transition section 84 between the flat section 80 and the twisted section 82 shown in FIG. 4, FIG. 6 shows another type transition section 84' to cooperate with the twisted sections 82 for compensating the skew phenomenon thereof. It can be noted in FIG. 4, the transition section 84 in FIG. 4 keeps the flat sections 80 equal while the transition section 84' in FIG. 6 keeps the twisted sections 82 equal. Anyhow, both transition sections are to smooth the impedance profile from the flat section to the twisted section.

Figure 7:
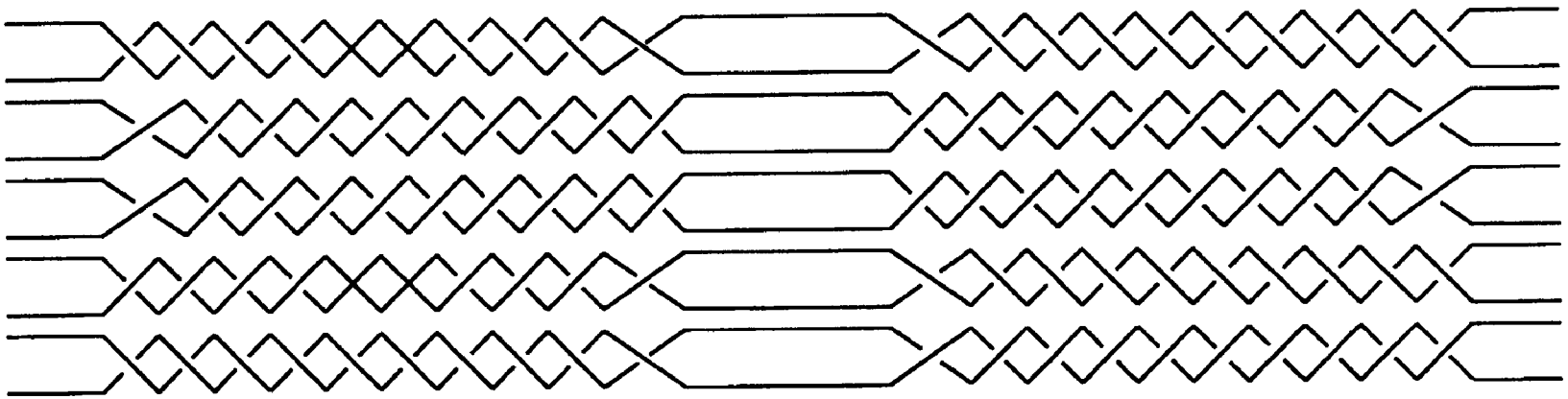
FIG. 7 is a simplified plan view of another twisted pair cable of the invention having two neighbor pairs of conductors having twist phase offset with regard to the other two neighbor pairs of conductors for compliance with another type manufacturing machine.

Additionally, FIG. 7 shows other type twisted pair cables wherein the offset is applied to every two adjacent pairs relative to the other adjacent two pairs for easy manufacturing. Understandably, the performance of the cables shown in FIG. 7 may be inferior to the one shown in FIG. 4.

It can be also appreciated that other than reducing forward crosstalk at the far end P of the cable 10, the backward crosstalk at the near end Q of the cable 10 is also reduced for the same reason.

The feature of the invention is to provide a reliable, predicable, controllable arrangement of the twisted pair cable not only efficiently eliminates the crosstalk but also is adapted to be made in a systematic way during manufacturing.

While the present invention has been described with reference to a few specific embodiment, the description is illustrative of the invention and is not to be construed as limiting the invention. Various modifications to the present invention can be made t other preferred embodiment by those skilled in the art without departing from the true spirit and scope of the invention as defined by the appended claims.

Therefore, persons of ordinary skill in this field are to understand that all such equivalent structures are to be included within the scope of the following claims.

We claim:

1. A twisted-pair cable comprising:

a plurality of pairs of conductors closely side by side positioned with one another, each pair of conductors confronting two adjacent pairs of conductors by two sides thereof; and two conductors of each pair of conductors twisted with each other along an axial direction of said pair of conductors; and a twist phase of a first pair of conductors being offset from that of second pair of conductors; wherein the second pair conductors is one of said two adjacent pairs of conductors with regard to the first pair of conductors; and wherein a cycle is defined by 0–360 degrees for each conductor of each pair of conductors during twisting, and the twist phase of the first pair of conductors is offset with 90 degrees relative to the second pair of conductors.

2. The cable as described in claim 1, wherein the pairs of conductors belonging to an odd number of said cable have a same twist phase with one another, and the pairs of conductors belonging to an even number of said cable have another same twist phase.

3. A twisted-pair cable comprising:

first, second and third pairs of conductors side by side positioned with one another, the first pair of conductors being positioned between the second pair of conductors and the third pair of conductors;

two conductors of each pair of conductors twisted with each other along an axial direction of said pair of conductors, each conductor of said two conductors being characterized of several cycle sections of twisting; wherein for each one conductor of the first pair of conductors, an induced signal around one half of each cycle section influenced by the second pair of conductors can be self-eliminated by the two conductors of the second pair of conductors, and another induced signal around the other half of each cycle section influenced by the third pair of conductors can be self-eliminated by the two conductors of the third pair of conductors;

wherein each cycle section is defined with a 0 through 360 degrees area including a first 0 through 90 degrees section, a second 90 through 180 degrees section, a third 180 through 270 degrees section and a fourth 270 through 360 degrees section, and the first section and the second section form said half, and the third section and said fourth section form said another half; and wherein the first section is influenced by one of the two conductors of the second pair of conductors, and the second section is influenced by the other of the two conductors of the second pair of conductors, while said two conductors of the second pair of conductors are of opposite polarities.

4. A twisted-pair cable comprising:

a plurality of pairs of conductors closely side by side positioned with one another;

two conductors of each pair of conductors twisted with each other along an axial direction of said pair of conductors; and each pair of conductors defining flat sections and twisted sections alternatively arranged therealong; wherein a first length of all the twisted sections of the pairs of conductors remain constant while a second length of all of flat sections of the pairs of conductors changes between two adjacent pairs of conductors; and wherein a cycle is defined by 0–360 degrees for each conductor of each pair of conductors during twisting, and the flat sections and the twist sections of the conductors of each pair of conductors are offset with 90 degrees relative to the other conductors of adjacent pair of conductors.

5. A twisted-pair cable comprising:

a plurality of pairs of conductors closely side by side positioned with one another;

two conductors of each pair of conductors twisted with each other along an axial direction of said pair of conductors; and each pair of conductors defining flat sections and twisted sections alternatively arranged therealong; wherein a first length of all the flat sections of the pairs of conductors remain constant while a second length of all of twisted sections of the pair of conductors changes between two adjacent pairs of conductors; and wherein a cycle is defined by 0–360 degrees for each conductor of each pair of conductors during twisting, and the flat sections and the twist sections of the conductors of each pair of conductors are offset with 90 degrees relative to the other conductors of adjacent pair of conductors.

6. A twisted-pair cable comprising:

a plurality of pairs of conductors closely side by side positioned with one another; and two conductors of each pair of conductors twisted with each other along an axial direction of said pair of conductors; and two closer points between one conductor of one pair of conductors and another conductor of the other adjacent pair of conductors are either at a same lateral position along the cable but one in the same plane parallel to the cable, or in the same plane parallel to the cable but not at the same lateral position along the cable, while with no events that said two closer points are commonly in the same plane parallel to the cable and at the same lateral position along the cable; and wherein a cycle is defined by 0–360 degrees for each conductor of each pair of conductors during twisting, and a twist phase of the one conductor of one pair of conductors is offset with 90 degrees relative to the another conductor of the other adjacent pair of conductors.

7. A twisted-pair cable comprising:

first, second and third pairs of conductors side by side positioned with one another, the first pair of conductors being positioned between the second pair of conductors and the third pair of conductors;

two conductors of each pair of conductors twisted with each other along an axial direction of said pair of conductors, each conductor of said two conductors being characterized of several cycle sections of twisting; wherein for each one conductor of the first pair of conductors, an induced signal around one half of each cycle section influenced by the second pair of conductors can be self-eliminated by the two conductors of the second pair of conductors, and another induced signal around the other half of each cycle section influence by a third pair of conductors can be self-eliminated by the two conductors of the third pair of conductors;

wherein each cycle section is defined with a 0 through 360 degrees area including a first 0 through 90 degrees section, a second 90 through 180 degrees section, a third 180 through 270 degrees section and a fourth 270 through 360 degrees section, and the first section and the second section form said half, and the third section and said fourth section form said another half;

wherein the third section is influenced by one of the two conductors of the third pair of conductors, and the fourth section is influenced by the other of the two conductors of the third pair of conductors, while said two conductors of the third pair of conductors are of opposite polarities.

* * * * *